US005106078A

United States Patent [19]

Rowe

[11] Patent Number: 5,106,078

[45] Date of Patent: Apr. 21, 1992

[54] WATER EXERCISER

[76] Inventor: Victor L. Rowe, 7117 De Palma St., Downey, Calif. 90241

[21] Appl. No.: 484,366

[22] Filed: Feb. 26, 1990

[51] Int. Cl.[5] ..... A63B 21/00

[52] U.S. Cl. ..... 482/138; 482/94; 482/92; 472/128

[58] Field of Search ..... 272/1 B, 71, 93, 116, 272/117, 118, 130, 134

[56] References Cited

U.S. PATENT DOCUMENTS

| | | | |
|---|---|---|---|
| 2,593,321 | 4/1952 | Lindgren | 272/1 B |
| 3,014,723 | 12/1961 | Butler | 272/1 B X |
| 4,603,855 | 8/1986 | Sebelle | 272/117 |
| 4,635,926 | 1/1987 | Minkow | 272/118 |
| 4,721,303 | 1/1988 | Fitzpatrick | 272/134 X |
| 4,900,018 | 2/1990 | Ish, III et al. | 272/118 X |

FOREIGN PATENT DOCUMENTS

| | | | |
|---|---|---|---|
| 2169812 | 7/1986 | United Kingdom | 272/118 |

*Primary Examiner*—Robert Bahr
*Attorney, Agent, or Firm*—Frank L. Zugelter

[57] ABSTRACT

An aquatic exercising device/apparatus (10) comprising a bed (11) mounted on a frame (12) supported by hollowed columns (13), and lines (17) extending through such columns (13), their one ends attached to floats (16) and their other ends attached to members (30) for or applied to the hands (31) and feet (32) of its user (26). As the user (26) pushes members (30) away, the buoyancy for floats (16) resist their submergence into the water (60) in which apparatus (10) is disposed. Tension thereby is produced for the user's muscles thus exercising them or particular ones. Neck muscles likewise are exercised in another embodiment or assembly (65) which includes a line (67) to which a head harness (66) is fastened, the line extending back to a pulley (71) dependingly mounted on a cross-beam which in turn is mounted to a hollowed standard (68), such line extending through standard (68) to be fastened to a float (16).

28 Claims, 3 Drawing Sheets

WATER EXERCISER

This invention relates to an exercising device, and in particular, to a warm water exercising apparatus useful for therapeutic and other health-wise purposes, for the benefit of human beings.

BACKGROUND OF THE INVENTION

Exercising in a warm liquid medium, such as a water heated pool, jacuzzi or tank, provides the advantage of the buoyancy of the liquid (water) to help arthritic persons, those recovering from trauma, the elderly in articulating exercises, etc. And this apparatus provides exercise for such users with minimum effort while maximizing their health benefits. Such exercise coupled with the healing effect of heated water and the massaging factor of a jet stream , such aT provided by a jacuzzi, provides therapeutic advantages heretofore not realized.

Prior art devices disclosing various exercising articles and apparata are disclosed in U.S. Pat. Nos. 3,427,022; 4,300,759; 4,551,108; 4,565,369; 4,804,177.

SUMMARY OF THE INVENTION

The invention comprises a padded, adjustable back rest or bed for maximum comfort for the body of its user, a neck support to keep the head out of the water, the back rest extending from the neck to mid-thigh and which is placed below the surface or level of the water, say, about 10 to 12 inches. It is anchored to supporting columns with hollow centers, the columns having sturdy walls to support the weight of the user. The hollow centers may be filled with water for more stability. The columns stand at the bottom of the water tank, pool or jacuzzi and preferably are provided with flared pedestals or feet for better stability. One pair of columns is placed at about the mid-thoracic plane and the other at about the hip level plane. On the exterior sides of and towards the bottoms of the columns, curvilinear tubes extend outwardly away from the longitudingal sides of the bed. Floatable articles (floats) are anchored to strong cords which are strung or threaded into the curvilinear tubes and up through the hollow centers of the columns. The cords in the columns at the thoracic level plane are ported adjacent the bed's longitudinal sides and continue to extend to a solid hand-piece member. Such member is covered by or with a spongy, finger-grooved wrapping or the like for grasping with comfort and for exercising the finger joints in an arthritic person or another who needs such exercising, simply by squeezing it. The length of each of these cords is just enough to keep its float firmly on the water's surface, not floating freely thereabout or thereon. Thus, when a user grasps a hand-piece member, pushing it away, the cord is pulled and the effect is to cause the float to descend down into the water against the resistance of the buoyancy of the water or liquid. This effort by the user provides the force to exercise the pectorales, biceps, triceps, deltoids and forearm muscles, and to strengthen ligaments and to provide better mobility of the wrist, elbow and shoulder joints. At the lower or hip level pLane, the same is done with the cords and floats which likewise cooperate through a second set of columns with foot bands or rings mounted upon the feet. By pushing one or both feet straight out, the user or patient exercises the muscles of the calf, biceps and triceps, femores, as well as hips and buttocks, and provides more flexibility of movement for the ankles, knee and hip joints. Further, by placing the feet in the rings, and adjusting the back of the apparatus to an almost upright position, the user can push down in the form of bicycle pedaling and receive the same beneficial effect. By reclining the apparatus to an almost horizontal position, the user can pull with the hands the foot rings themselves, as in the form of rowing, and this exercises the upper back muscles.

Another embodiment or as an integral assembly to the invention includes a head harness which is attached to the head to exert tension upward on the neck. By using the already existing head or face of the user by means of the head harness, a fifth (5th) float connected to the harness via its cord provides the necessary resistance to the buoyancy of the water to achieve the desired force(s) for exercising the neck muscles.

An object of this invention is to provide relief or recovery from aches, pains, and other miseries associated with illnesses or aliments or diseases to the human body.

A further object of this invention is to provide a novel therapeutic exercising device.

Another object of this invention is to provide simpler and more effective exercising movements for a user of the apparatus.

A still further object of this invention is to maximize the therapeutic values of heated liquid or water for arthritic sufferers and other patients with similarly-disposed aliments.

A further object of the invention is to simplify the manner of exercising arthritic joints by maximizing the benefits of use of heated water or liquid.

These and other objects of the invention will become more fully apparent upon a complete and full reading of the following description, the appended claims thereto, and the accompanying drawing comprising three (3) sheets of seven (7) FIGURES.

Best Mode of Carrying Out the Invention

Figure 2:
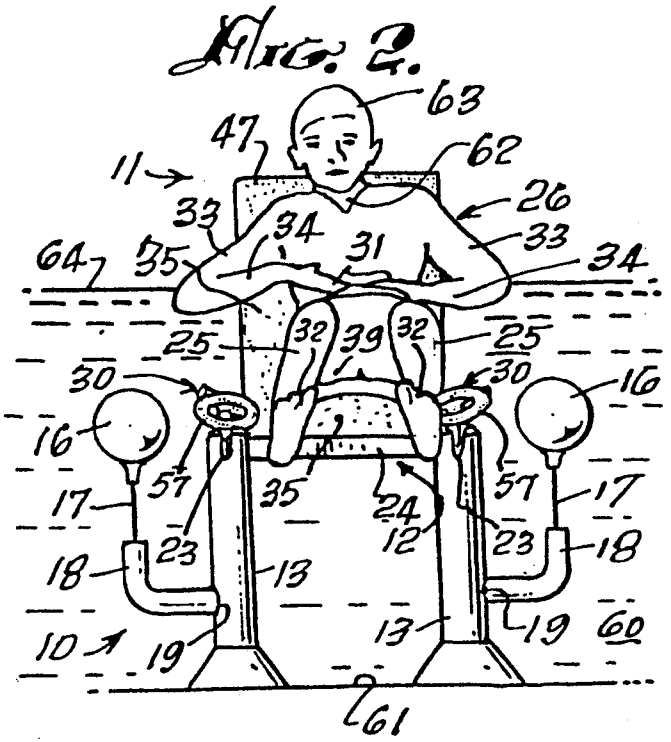
FIG. 2 is a frontal elevational view of FIG. 1, however, the human being is sitting merely on its bed.
Figure 1:
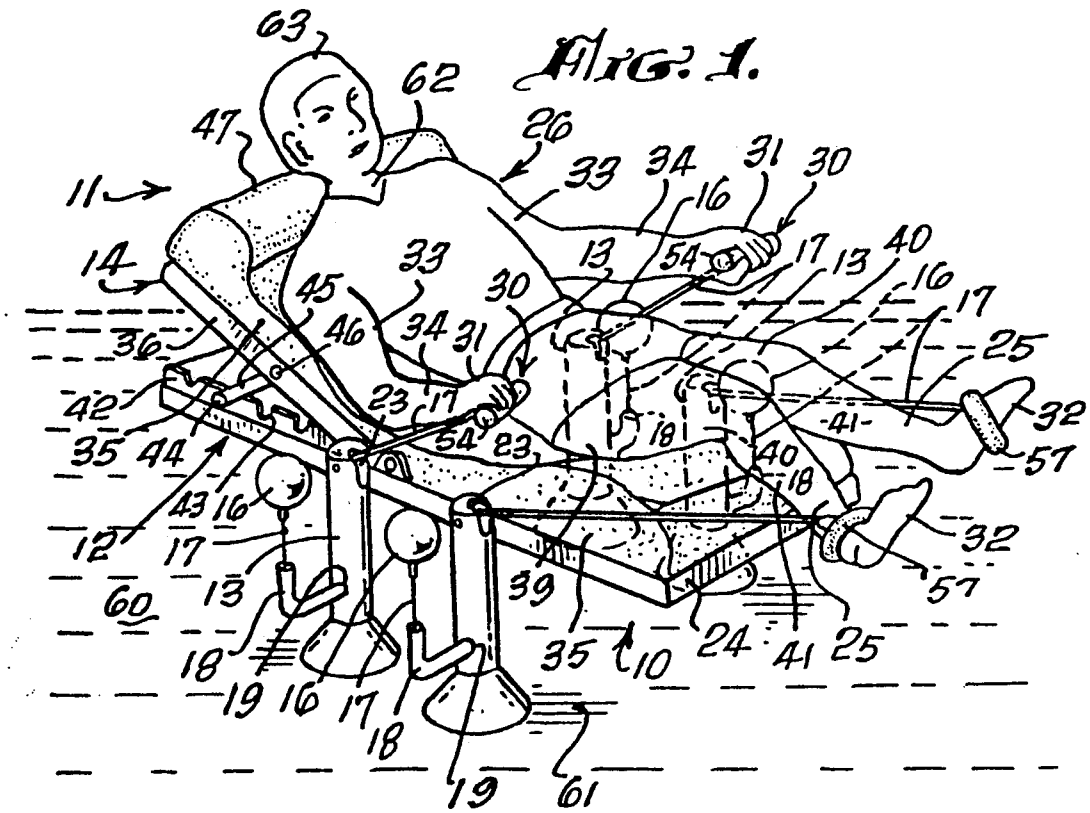
FIG. 1 is a perspective view of the subject matter of the invention as it is being utilized for exercise by a human being.

Referring now to the drawing FIGURES wherein reference characters correspond to like numerals hereinafter, reference character 10 refers to an apparauts which embodies my invention. Apparatus 10, FIGS. 1, 2, comprises generally a bed 11 mounted on a frame 12 supported or sustained in an elevated manner by a plurality of spaced columns 13 to which frame 12 is suitably mounted or attached, an adjustable back rest or reclining means 14 mounted to frame 12, buoyant members or floats 16 to each of which a strong line or cord 17 has its one end suitably attached thereto, and a plurality of guiding conduits 18 curvilinearly configured for ease of line movement therein and to facilitate access of line 17 through a port 19 at a lower point in the column and into a hollow chamber 20, of FIG. 6, of a corresponding column 13 to which a corresponding one of conduits 18 is attached. The path of each line 17 from a float 16 continues from the lower point in its column to extend in an upward direction within its chamber 20, to egress therefrom through a port 23 formed in its corresponding column 13 at a location or upper point in the column adjacent the height of bed 11, each port 23 being disposed in its column 13 in a direction such that a line 17 egressing therefrom egresses in a direction generally parallel to the longitudinality of apparatus 10 and towards the short edge 24, FIG. 3, for frame 12 over which legs 25 of a user 26 bedded down on apparatus 10 extend. A freely rotatable pulley 28 is mounted within each chamber 20 of a column 13, adjacent its egress port 23, to facilitate the change of direction of movement of line 17 as it egresses out of its column 13, each mounting provided by means of a shaft 29 journalled or otherwise supported in the walls of its column 13. At the other end of each of lines 17, means 30 for a user's extremity, such as a hand 31 or foot 32, is suitably attached thereto. It may be noted that the columns 13 do not extend above the level of frame 12 so that the user's arms 33 and forearms 34 are not restricted in movement or motion during exercising by interference from such columns.

Figures 3, 4, 5:
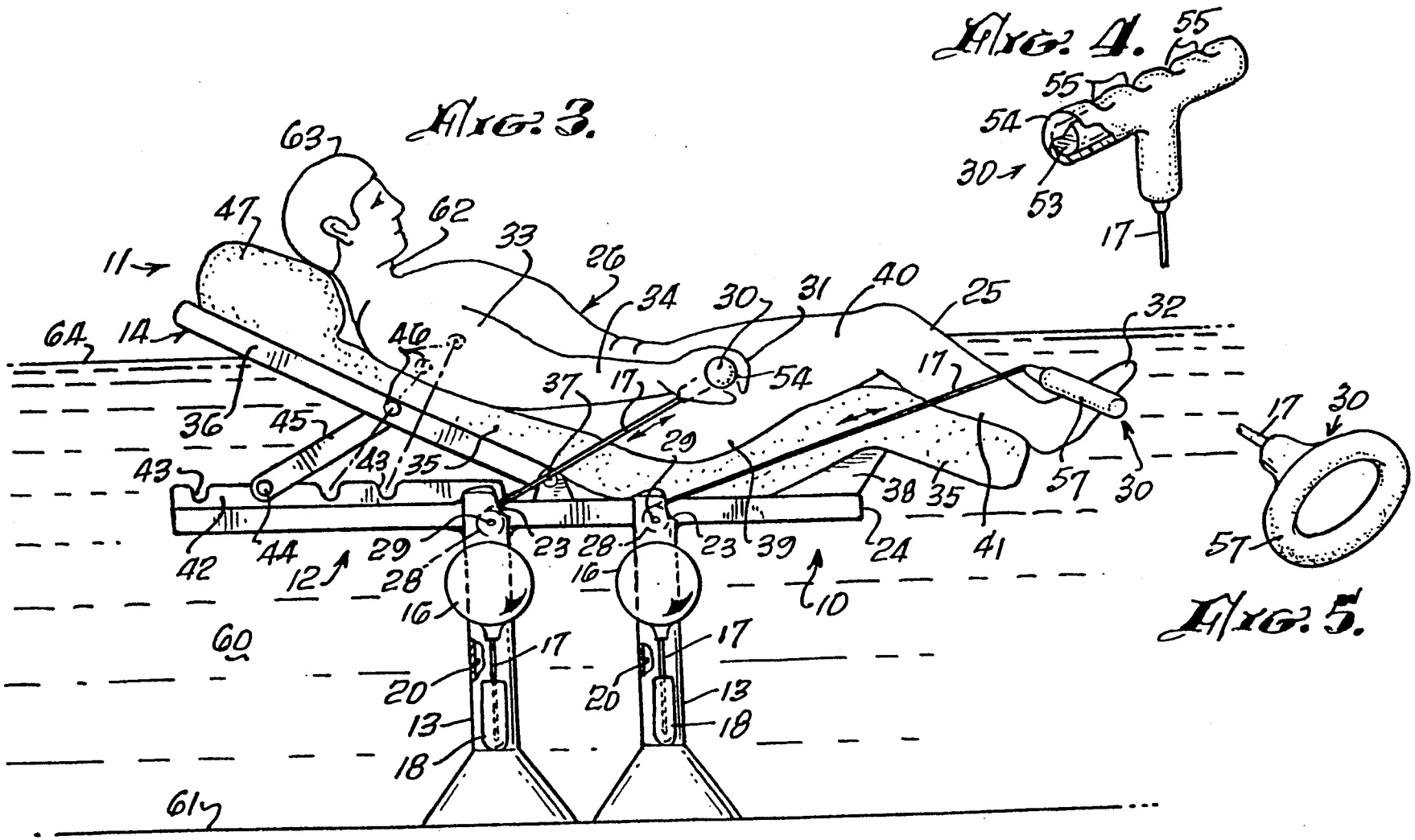
FIG. 3 is a side elevational view of FIG. 1.
FIGS. 4 and 5 are schematic or perspective views of handles and rings for the hands and feet, respectively, of the exerciser while using the invention.
Figures 6, 7:
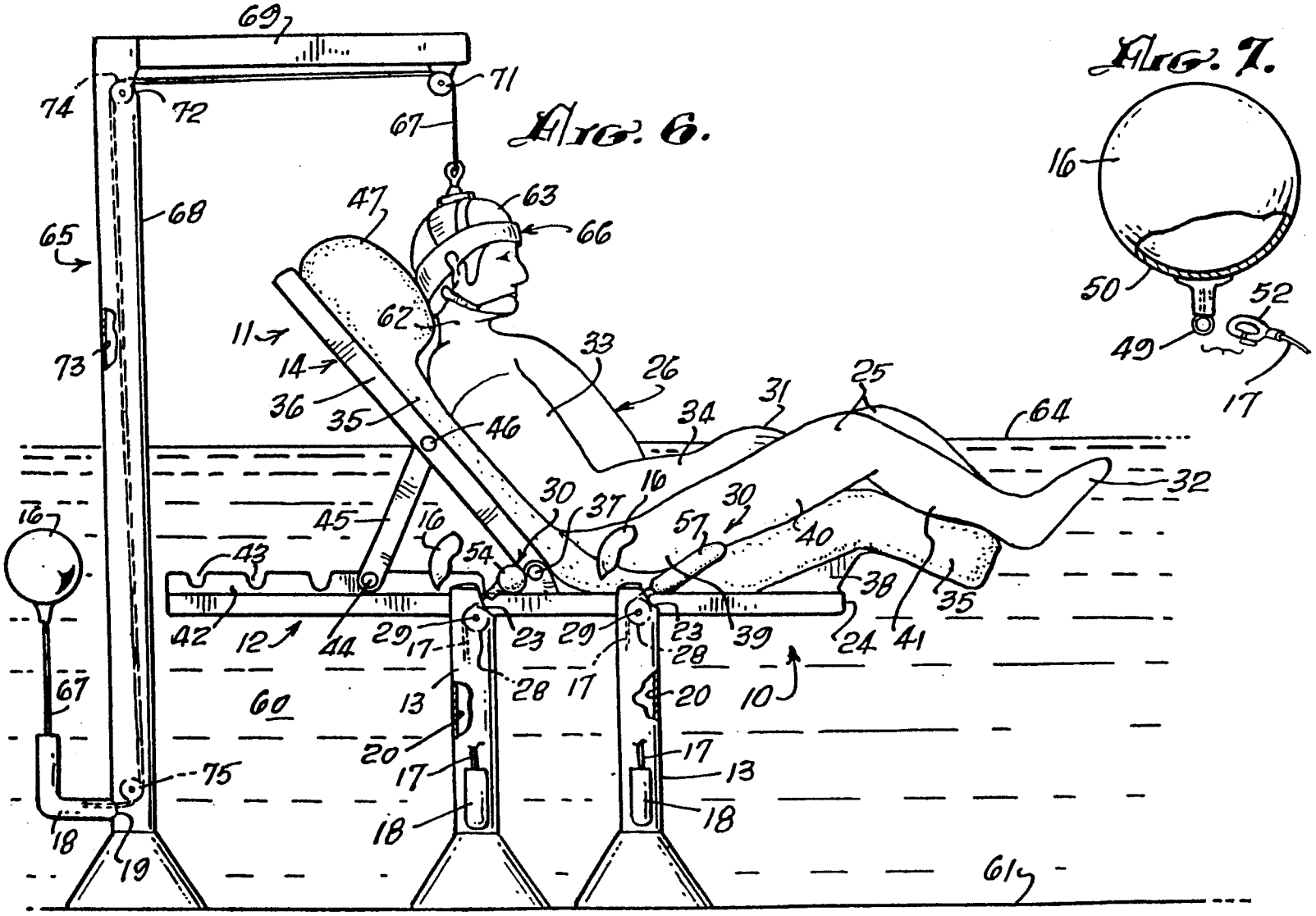
FIG. 6 is a side elevational view of another assembly or of another embodiment of the invention.
FIG. 7 is a full view, partly cutaway, of a float used in the employment of the invention.

Bed 11, FIGS. 3, 6, comprises a cushion or pad 35 mounted on a board 36 pivotally mounted as at 37 to frame 12, pad 35 continuing to extend towards edge 24. In such extension, pad 35 mounts upon a firm support lift 38 securely mounted to frame 12 in proximity to or adjacent a vertical plane for edge 24. Lift 38 is contoured so that the portion of pad 35 thereon engages the buttocks 39 and thighs 40 of user 26. Pad 35 continues to extend beyond lift 38 so that the leg calves 41 of user 26 also are supported thereon.

The pivot at 37 provides for inclusion of adjustability features in reclining means 14, in the form of a pair of racks 42 (only one is visible in FIGS. 1, 6) securely mounted along longitudinally extending edges of frame 12, under board 36. Each of racks 42 includes spaced notches 43 into a corresponding pair of which a transversely-disposed bar 44 seats. Bar 44 is suitably secured to a pair of links 45 each being pivotally mounted to and along a corresponding edge 46 on board 36. Thus, the positioning of bar 44 from one pair of corresponding notches 43 to another either elevates or lowers the back rest or reclining means 14. The pad 35 in reclining means 14 includes a neck or head rest 47 at its upper terminus.

Each float 16, FIG. 7, comprises a hollow air-tight object or buoyant member capable of floating on a water's surface when no tension has been applied to it. A means 49, such as an eyelet, is suitably securely mounted to the wall 50 forming float 16, so that a release eyelet 52 secured to the one end of each line 17 is applied or fastened to eyelet 49 for connecting float to line.

FIGS. 4 and 5 illustrate particular forms of means 30 which are grasped by hands and feet. In FIG. 4, a solid wooden core 53 in the form of a T is securely mounted to line 17, while a finger-squeezable material 54 is suitably mounted thereto. Finger grooves 55 are provided in core and material within the head of the T of FIG. 4, while the leg of the T is attached to line 17. In FIG. 5, a ring 57 of size to fit over the foot of the user is securely attached to its line in a suitable manner.

In its use, apparatus 10 is disposed within a tank of water 60, its columns 13 setting on its floor 61. The user of 26 mounts pad 35 after a proper adjustment to reclining means 14 has been accomplished by placing bar 44 in a desired pair of spaced notches 43. The user's back engages pad 35, with the user's neck 62 resting on headrest 47 as desired. The buttocks 39 engage the lowest area on pad 35, while the thighs 40 and calves 41 mount on the lower portion of pad 35 that is supported by lift 38. The feet 32 extend beyond the lower end of pad 35. Each foot 32 is inserted through its corresponding ring 57 while the hands 31 of the user grasp their corresponding means or handles 30. The head 63 of the user is situated above the water's level 64 in tank 60, while floats 16 set thereon. However, it is to be noted that the initial position for floats 16 prior to use of apparatus may be below level 64, as is illustrated in FIG. 6, and whether or not grasping means 30 are initially positioned immediately adjacent to their columns 13. Lines 17 should be taunt to the user's grasping of means 30 at the initial step of exercising to be performed. User 26 pushes either means 30, i.e., the finger handles and/or the foot rings, singly or in a desired pattern or routine of pushing one or some or all of them in a way away from the user's self, so to speak. This in turn pulls a corresponding line or lines 17 that control or controls the movement of a float or floats 16. The movement of such float(s) is into the water's depth as the user so pushes. Tension against particular muscles is developed, thereby providing the exercising and therapeutic values desired by the user. It is the resistance of the corresponding floats to their submergence in the water, i.e., against the buoyancy of the water to the floats, which provides the tension upon the muscles.

FIG. 6 illustrates another embodiment of the invention, although it may also be considered an integral part of an assembly to the aforedescribed embodiment. In this embodiment or assembly, the muscles in neck 62 of user 26 are exercised. This assembly comprises a suitable head harness 66 attached to a line 67 which freely reciprocates in its mounting upon a standard 68 to which a cross-beam 69 is securely mounted for disposition over the head 63 of the user. Head harness 66 is suitably secured to the strong line or cord 67 whose path extends back up to cross-beam 69 and about a freely rotatable pulley 71 dependingly mounted thereon, and continuing to extend to the distal end of the beam 69 where it enters via an ingress port 72 into a hollow chamber 73 in standard 68, once again passing around a freely rotatable pulley 74 suitably mounted therein, to descend to the proximity of the bottom of standard 68, where, after passing around another freely rotatable pulley 75 mounted in chamber 73, it egresses therefrom into a guiding means or conduit 18 and thence out of that to be releasably fastened to a float 16. Standard 68 is disposed at the head end of apparatus 10, and can be integrally formed, such as by welding, to frame 12. Its use requires a more upright or sitting position for user 26. In use, motion of the user's head 63 provides movement of line 67 against the resistance of float 16 to its bouyancy in the water. Tension is developed in such motion and produces the exercising and/or therapeutic valves sought for the user's neck while strengthening its muscles.

It should be understood that set-up for use of apparatus 10 and assembly 65 is not limited to one particular arrangement. The position of any one or more or all floats 16 need not be limited to floating on the water's level 64 with no slack in the corresponding lines 17 prior to use. Also, the float(s) may initially be submerged, partially or completely prior to the beginning of any exercising step. Frame 12 need not be disposed in level manner in each instance of use. With use of the unit or assembly 65, user 26 is generally seated in an upright manner, however, the back rest 14 may be adjusted to provide a reclining position if desired.

In assembly of apparata 10, 65, frame 12 is welded to columns 13, while back rest 14 is pivotally mounted to both longitudinal edges at its pivots 37. A pair of racks 42 is suitably attached to frame 12 along its longitudinal edges while links 45 are mounted to their pivot positions on edges 46 and bar 44 is mounted between and to links 45. Pad 35 is mounted to board 36, frame 12 and support lift 38. Guiding means or conduits 18 are welded to columns 13. Lines 17 are threaded through their corresponding columns 13 and pulleys therein and then attached or fastened to floats 17 and means 30, accordingly. Standard 68 in unit 65 may be welded or otherwise attached to or assembled separately from frame 12. Cross-beam 69 and conduits 18 are securely mounted to standard 68, and its remaining assembly follows that described above relative to apparatus 10.

Suitable materials known in the art adapt themselves to the aforesaid described elements. Metal, wood, and today's plastics are available for such elements except for pad 35 which is of a fabric or material (even plastic) on or against which a user's body feels comfortable. Handles should be of lightweight material such as wood, with spongy material covering their cores. The lines 17 are formed from wiring, plastic or other suitable materials. Floats 16 are of rubber and may be of various sizes.

Various changes and modifications may be made without departing from the spirit and scope of the invention. Also, the degree of warmth of the water does not affect the effective operation of apparata 10, 65, though such degree is useful therapeutically. Also, the frame's width may be varied to provide whatever height is desired for columns 13, so long as they do not interfere with the exercising movement of arms, forearms, thighs and legs of the user. And although FIG. 6 does not show a direct attachment between standard 68 and frame 12, it is to be understood that the inventive concept comprehends such a connection, standard 68 being integrally formed to frame 12 or releasably detachable therefrom by suitable and known manner. Furthermore, as many pulleys necessary or desired to facilitate cord movement within or without the hollow chambers of columns and standard may be utilized. And it should be understood that an extremity of the user if the user's head as well as the user's hand and feet. Also, varying the position of one or more floats below the water's level provides for adjustment of a desired pressure or tension that is delivered to the means 30 grasped by the extremities during the user's exercising.

I claim:

1. In an exercising apparatus for operation in water and including column means having lower and upper points and adapted to support a bed above the lower of such points, means for an extremity of a user to grasp, at least one cord having first and second ends and being operatively connected to one of said column means at said lower and upper points, and a buoyant member connected to the second of said ends, the first of said ends being connected to the extremity means, the improvement comprising the path of the cord from the second of said ends extending directly to the lower point on said one of said column means at which operative connection takes place, the path of the cord from the first of said ends extending directly to the upper point on said one of said column means at which operative connection takes place, whereby movement by the user of said extremity means causes the buoyant member to resist submergence through water and thereby provide tension on one or more muscles of the user in such movement.

2. In the apparatus of claim 1, the improvement including a frame and a bed for supporting a user.

3. In the apparatus of claim 2, the improvement including reclining means for said bed.

4. The improvement of claim 1 or claim 2 or claim 3 including guiding means mounted to at least said one of said column means at the lower one of said points, the path of the cord extending through said guiding means.

5. The improvement of claim 1 wherein said one of said column means includes a hollow chamber having spaced ports at said lower and upper points, the path of said cord extending from said first and second ends into and through sid hollow chamber via said ports.

6. The improvement of claim 5 including pulley means disposed in said hollow chamber for facilitating movement of its cord mounted therearound.

7. The apparatus of claim 6 including a frame and a bed mounted on said column means, for reclining means for said bed.

8. The improvement of claim 5 including guiding means mounted to at least said one of said column means at the lower one of said points, the path of the cord extending through said guiding means into the hollow chamber.

9. The improvement of claim 8 wherein said guiding means comprises a curvilinear conduit.

10. The improvement of claim 8 or claim 9 including pulley means disposed in said hollow chamber for facilitating movement of its cord mounted therearound.

11. The apparatus of claim 8 or claim 9 including a frame and a bed mounted on said column means, and reclining means for said bed.

12. An exercising apparatus for operation in water comprising column means having lower and upper points, supporting means for a user mounted on said column means above the lower of such points, means for an extremity of the user to grasp, at least one cord having first and second ends and being operatively connected to at least one of said column means at said lower and upper points, said extremity means connected to the first of said ends, a buoyant member connected to the second of said ends, the path of the cord from the second of said ends extending directly to the lower point on said one of said column means at which operative connection takes place, the path of the cord from the first of said ends extending directly to the upper point on said one of said column means at which operative connection takes place, whereby movement by the user of said extremity means causes the buoyant member to resist submergence through the water and thereby provide tension on one or more muscles of the user in such movement.

13. The apparatus of claim 12 including reclining means for said supporting means.

14. The apparatus of claim 12 wherein each of said column means has a hollow chamber and spaced ports for such chamber at each of said lower and upper points, the path of said cord extending into and through said hollow chamber via said ports.

15. The apparatus of claim 14 including guiding means mounted to each said one of said column means at the lower of said points, the path of the cord extending through said guiding means into the hollow chamber.

16. The apparatus of claim 15 wherein said guiding means comprises a curvilinear conduit.

17. The apparatus of claim 14 or claim 15 or claim 16 including pulley means disposed in said hollow chamber for facilitating movement of its cord mounted therearound.

18. The apparatus of claim 12 including guiding means mounted to each said one of said column means at the lower of said points, the path of the cord extending through said guiding means.

19. The apparatus of claim 18 or claim 14 or claim 15 or claim 16 including reclining means for said supporting means.

20. The apparatus of claim 17 including reclining means for said supporting means.

21. An exercising device comprising a standard having lower and upper points, a cross-beam mounted on said standard and having a point therealong, pulley means dependingly mounted on said cross-beam at said point, float means, and cord means having first and second ends and being operatively connected to said standard at its lower and upper points and to said cross-beam at its point, the path of said cord means extending from the lower of said points directly to and being fastened to said float means at its second end, the path of said cord means also extending from the upper of said points to said point on said cross-beam and around said pulley means for fastening at its first of said ends to a grasping means mountable to an extremity of a user operating the device.

22. The exercise device of claim 21 including grasping means fastened to the first of said ends on said cord means.

23. An exercising device comprising a standard having a hollow chamber and upper and lower ports therefor, a cross-beam mounted on said standard, pulley means dependingly mounted on said cross-beam, float means, and cord means extending through said hollow chamber and ports, said cord means extending through the lower of said ports and fastened to said float means at its first end, and extending through the upper of said ports, around said pulley means, and fastenable at its second end to a grasping means mountable to an extremity of a user operating the device.

24. The device of claim 23 including a grasping means fastened to the second end of said cord means.

25. The device of claim 24 wherein said grasping means comprises a head harness.

26. An exercising apparatus comprising column means adapted for disposition on a floor of a tank containing water, means for supporting a user mounted on said column means, means for an extremity of the user of said apparatus, means including first float means operatively connected to said grasping means through said column means for achieving tension on at least one muscle of the user in the operation of the apparatus, standard means mounted to said supporting means and having a hollow chamber and first upper and lower ports therefor, a cross-beam mounted to said standard means, pulley means dependingly mounted on said cross-beam, second float means, and cord means extending through said hollow chamber and ports, said cord means extending through the lower of said ports and fastened to said second float means at its first end, and extending through the upper of said ports, around said pulley means, and adapted for fastening to a different grasping means

27. The device of claim 23 including a grasping means fastened to the second end of said cord means.

28. The device of claim 27 wherein said grasping means comprises a head harness.

* * * * *

UNITED STATES PATENT AND TRADEMARK OFFICE

CERTIFICATE OF CORRECTION

PATENT NO. : 5,106,078

DATED : April 21, 1992

INVENTOR(S) : Victor L. Rowe

It is certified that error appears in the above-identified patent and that said Letters Patent is hereby corrected as shown below:

In Col. 6, line 32, read "sid" as --said--.

In Col. 6, line 39 should read without reading the printed "for" insert "and".

In Col. 8, line 50, a period (--.--) should be read after "means" .

In Col. 8, line 51, "23" should be read as - - 26 - - .

Signed and Sealed this

Third Day of August, 1993

*Attest:*

Michael K. Kirk

MICHAEL K. KIRK

*Attesting Officer*

*Acting Commissioner of Patents and Trademarks*